US005971364A

United States Patent [19]

Ueno et al.

[11] Patent Number: 5,971,364

[45] Date of Patent: Oct. 26, 1999

[54] HOIST AND TRACTION APPARATUS

[75] Inventors: Yosio Ueno; Eikiti Kobayasi, both of Osaka, Japan

[73] Assignee: Elephant Chain Block Co., Ltd., Osaka, Japan

[21] Appl. No.: 09/176,262

[22] Filed: Oct. 20, 1998

[51] Int. Cl.[6] ..... B66D 1/14

[52] U.S. Cl. ..... 254/369; 254/372; 254/375

[58] Field of Search ..... 254/358, 372, 254/369, 375, 376, 383, 384, 385

[56] References Cited

U.S. PATENT DOCUMENTS

| | | | |
|---|---|---|---|
| 1,458,354 | 6/1923 | Neller | 254/372 X |
| 1,937,331 | 11/1933 | Coffing | 254/372 X |
| 2,480,303 | 8/1949 | Pennell | 254/369 X |
| 2,587,059 | 2/1952 | Mersereau | 254/369 X |
| 3,776,514 | 12/1973 | Eggleton, Jr. et al. | 254/375 |
| 4,479,635 | 10/1984 | Maeda | 254/376 X |
| 4,948,098 | 8/1990 | Nishimura | 254/372 |
| 5,238,226 | 8/1993 | Nishimura | 254/372 X |
| 5,364,073 | 11/1994 | Sell | 254/369 |

FOREIGN PATENT DOCUMENTS 63-60575 4/1988 Japan .

*Primary Examiner*—Donald P. Walsh
*Assistant Examiner*—Emmanuel M. Marcelo
*Attorney, Agent, or Firm*—Dickstein Shapiro Morin & Oshinsky LLP

[57] ABSTRACT

In order that an operating lever for a hoist and traction apparatus is combined as a unit to ensure the smooth operations so as to provide an improved workability with achieving a downsizing, a driving member of the hoist and traction apparatus is provided with a non-circular configured part, while also the operating lever is provided with a ratchet wheel having a non-circular fitting hole engageable with the non-circular configured part to be non-rotatable relative thereto and a transmission tooth around its outer periphery; a feed pawl engageable with the ratchet wheel; and a switching mechanism for selectively switching the feed pawl to a normal engagement position, a reverse engagement position, and a free rotation position at which the feed pawl is not engaged with the ratchet wheel in either of the normal and reverse directions. The operating lever combined as a unit enables the apparatus to be downsized, and the switching of the feed pawl to the free rotation position enables the operating lever to be prevented from being rotated together with the load sheave.

10 Claims, 18 Drawing Sheets

HOIST AND TRACTION APPARATUS

BACKGROUND OF THE INVENTION

1. Field of the Invention

The present invention relates to a hoist and traction apparatus and, more particularly, to a compact and lightweight hoist and traction apparatus for use in lifting or tying a load or tensioning a rope and the like.

2. Description of the Prior Art

Known as a compact and lightweight hoist and traction apparatus for use in lifting or tying a load or tensioning a rope and the like is the one disclosed by Japanese Laid-Open Utility Model Publication No. Sho 63-60575 and shown in FIG. 25. In the prior art shown in FIG. 25, a body 1 includes therein a load sheave accommodating part 3 in which a load sheave 2 is inserted and a chain guide passage 4 which communicates with the load sheave accommodating part 3 at its one end and opens to outside at the other end, for guiding a load chain passing over the load sheave 2. The load sheave accommodating part 3 and the chain guide passage 4 are integrally formed with the body 1. The load sheave 2 is rotatably supported in the load sheave accommodating part 3. At an outside of one axial end of the load sheave 2, a ratchet wheel 5 having a larger diameter than the load sheave 2 is provided, and at an outside of one axial end of the ratchet wheel 5, a handle fitting part 6 having a hexagonal configuration is provided. Further, the body 1 is provided with a reverse rotation stop pawl 7 engageable with the ratchet wheel 5.

The load sheave 2 is driven to rotate by rotational operation of a jig such as a closed wrench 8 detachably fitted onto the handle fitting part 6, to take up and down the load chain passing over the load sheave 2.

This conventional structure involves a troublesome operation in that the jig must be operated to rotate for taking up and down the load chain.

It may be practical for solving this problem that instead of the closed wrench, a swingably operated ratchet wrench is fitted on the handle fitting part 6 to take up and down the load chain. But, such still has a disadvantage that for example when the load chain on its unloaded side is pulled in advance to take up the slack of the load chain on the loaded side for acceleration of a hoisting work, with the load sheave 2 put into a freely rotatable state by disengaging the reverse rotation stop pawl 7 from the ratchet wheel 5, the ratchet wrench fitted on the handle fitting portion 6 is rotated together with the load sheave 2 to hinder smooth operations.

SUMMARY OF THE INVENTION

Accordingly, it is the object of the present invention to provide a hoist and traction apparatus in which an operating lever for the hoist and traction apparatus is combined as a unit to ensure the smooth operations to improve workability, with downsizing the apparatus.

A hoist and traction apparatus according to the invention comprises a body having a hook; a load sheave rotatably supported in the body; a drive shaft for driving the load sheave; a driven member connected with the drive shaft to be non-rotatable relative thereto; a driving member connected with the drive shaft to be rotatable relative thereto; a reverse rotation stop gear connected with the drive shaft to be rotatable relative thereto; a reverse rotation stop pawl provided at the body and engageable with the reverse rotation stop gear; and an operating lever for driving the driving member, wherein the driving member has a non-circular configured part, and the operating lever comprises a ratchet wheel having a non-circular fitting hole engageable with the non-circular configured part to be non-rotatable relative thereto and a transmission tooth provided around its outer periphery; a feed pawl engageable with the transmission tooth of the ratchet wheel to propel the ratchet wheel in the normal direction or in the reverse direction; and a switching means for selectively switching the feed pawl to a normal engagement position, a reverse engagement position, and a free rotation position at which the feed pawl is not engaged with the ratchet wheel in either of the normal and reverse directions.

This construction can provide the results that attachment of the operating lever can be readily performed by fitting the operating lever at the non-circular fitting hole onto the non-circular configured driving member, enabling the operating lever to be combined as a unit so as to render the apparatus compact; that the hoisting and lowering of a load can be done by the swinging motion of the operating lever; and that even when the load chain on its unloaded side is pulled in advance to take up the slack of the load chain on the loaded side for acceleration of a hoisting work after the load sheave is put into a freely rotatable state by disengagement of the reverse rotation stop pawl from the reverse rotation stop gear, the operating lever can be prevented from being rotated together with the load sheave by shifting the feed pawl into the free rotation position, to ensure smooth operations and provide an improved workability.

According to the invention, it is preferable that the operating lever includes a pair of side plates and a frame for enclosing the pair of side plates at their margins, the switching means including a spring for biasing the feed pawl toward the transmission tooth and a switching operation portion formed on the feed pawl, the feed pawl being swingably pivoted between the pair of side plates and adapted to be held at any selected position among the normal engagement position, the reverse engagement position and the free rotation position by the biasing force of the spring, the frame including a spring accommodating portion for accommodating the spring and a window for letting the switching operation portion out, which are both integrally formed in the frame. This construction provides the advantage that the operating lever having the switching means can be realized with a simple structure, and also since the spring accommodating portion and the window are integrally formed in the frame, parts count can be reduced to manufacture the operating lever with ease and at reduced costs.

Further, according to the invention, it is desirable that a load sheave accommodating part in which the load sheave is inserted; a chain guide passage which communicates with the load sheave accommodating part at its one end and opens to outside at the other end, for guiding a load chain passing over the load sheave; and a hook mounting part are integrally formed in the body. The construction in which the load sheave accommodating part, the chain guide passage and the hook mounting part are integrally formed in the body requires no particular parts for fitting these parts to the body, thus reducing costs and size of the apparatus. Further, this constructed body may be formed of a lightweight material such as aluminum or the alloy to achieve the weight reduction of the apparatus. In addition, the body can be formed into a suitable shape and size for holding it with one hand to provide an improved operability at the time of hoisting up and down.

Further, according to the invention, it is advantageous that an opening which communicates with the load sheave accommodating part to open the same to outside is formed in the body, and a chain guide for guiding the chain into and from the load sheave is fixed in the opening so that the chain guide passage can be defined at both sides of the chain guide. This construction, in which the opening which communicates with the load sheave accommodating part to open the same to outside is formed in the body, can provide the advantage that when the body is formed in a die casting or the like, a molding tool therefor can be simplified to reduce manufacturing costs. Further, since the chain guide can be fixed in the body to define the chain guide passage at the both sides, the load chain can be smoothly guided into and from the load sheave to drive the load sheave smoothly.

In addition, according to the invention, it is further preferable that the body is provided, at its end portion on the opening side of the chain guide passage, with a pair of vertical grooves and a pair of horizontal grooves intersecting the vertical grooves at right angles. This construction can provide the result that before the load chain goes into the chain guide passage in a twisted state in which a chain link of the load chain is out of position, the out-of-position chain link is so guided that it can be abutted on an edge of the body on the opening side to correct the twist in the load chain by means of a force for the load chain to be pulled into the load sheave, thus enabling the load chain to go into the chain guide passage with its returned to the normal state. Further, the pair of vertical grooves and the pair of horizontal grooves located at the end portion of the body on the opening side require no particular members to remove twist in the load chain, thus providing reduction in size, weight and costs of the apparatus.

Additionally, according to the invention, it is desirable that the hook mounting part has a penetration part penetrating widthwise of the body and an insertion hole bored in a top wall of the penetration part at a place in an upper part of the body isolated from the load sheave accommodating part, and the hook has a mounting shaft which is inserted in the insertion hole and is fixed at its inserted end portion by a fixing member inserted in the penetration part so that the hook can be rotatably supported to the body. With this construction, since the hook is held in the penetration part of the body, the holding of the hook can be made with a simple structure without reducing the strength of the body, thereby achieving reductions in size, weight and costs.

Further, according to the invention, it is advantageous that the drive shaft is integrally formed with the load sheave and also the load sheave is held to the body by means of the load chain passing over the load sheave. With this construction, since the drive shaft and the load sheave are formed in one piece, reduction of parts count and costs reduction can be achieved. Also, since the load sheave is held to the body by means of the load chain, no particular parts are needed for holding the load sheave to the body, thus achieving the simplified structure and the lightweight and the costs reduction.

Preferably, according to the invention, the body is provided, on a side wall thereof, with a first protection projecting around the reverse rotation stop gear. With the provision of the first protection, an operator's hand grasping the body can be held on the side wall of the first protection to be protected from coming into contact with the reverse rotation stop gear, thus achieving smooth driving operations of the load sheave with the firmly grasping of the body.

Further, according to the invention, the body is provided, on the side wall thereof, with a second protection projecting outside the reverse rotation stop gear. With the provision of the second protection, the operator's hand grasping the body can be held on the side wall of the second protection to be prevented from coming into contact with the reverse rotation stop pawl. This can provide the advantage that the reverse rotation stop pawl can be avoided being erroneously disengaged from the reverse rotation stop gear, while the body is firmly rasped with his hand.

Also, according to the invention, the body may be composed of two or more split bodies. By forming the body by two or more split bodies, the forming of the body can be further simplified and also the assembling of parts into the body can be simplified.

BRIEF DESCRIPTION OF THE DRAWINGS

The invention will now be described with reference to the accompanying drawings wherein.

DETAILED DESCRIPTION OF THE PREFERRED EMBODIMENT

Referring now to the accompanying drawing figures, an example of the preferred embodiment of the invention is described below. It is to be understood, however, that the scope of the invention is by no means limited to the illustrated embodiments.

Figure 1:
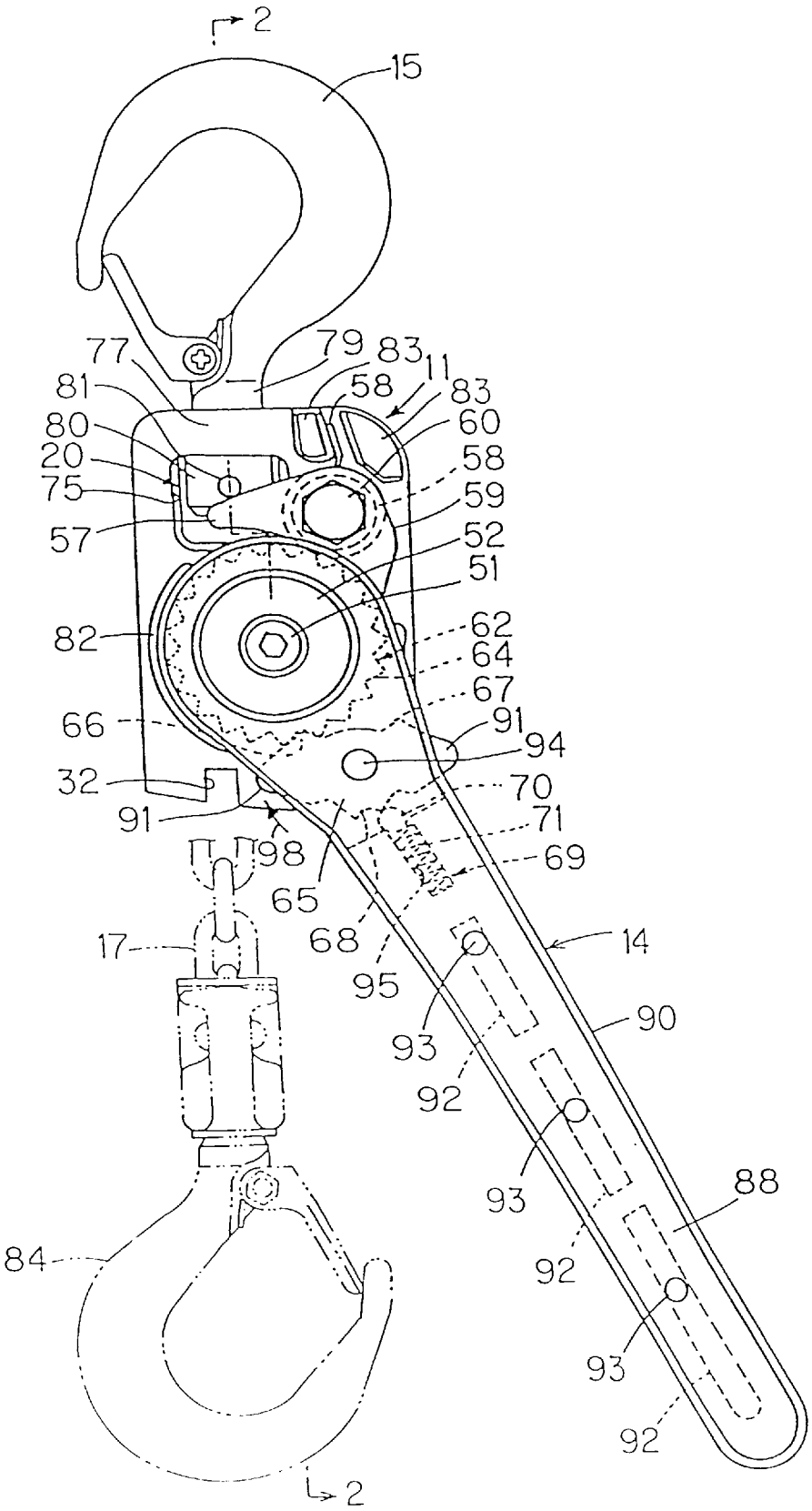
FIG. 1 is a front view of a hoist and traction apparatus showing one embodiment of the invention.
Figure 2:
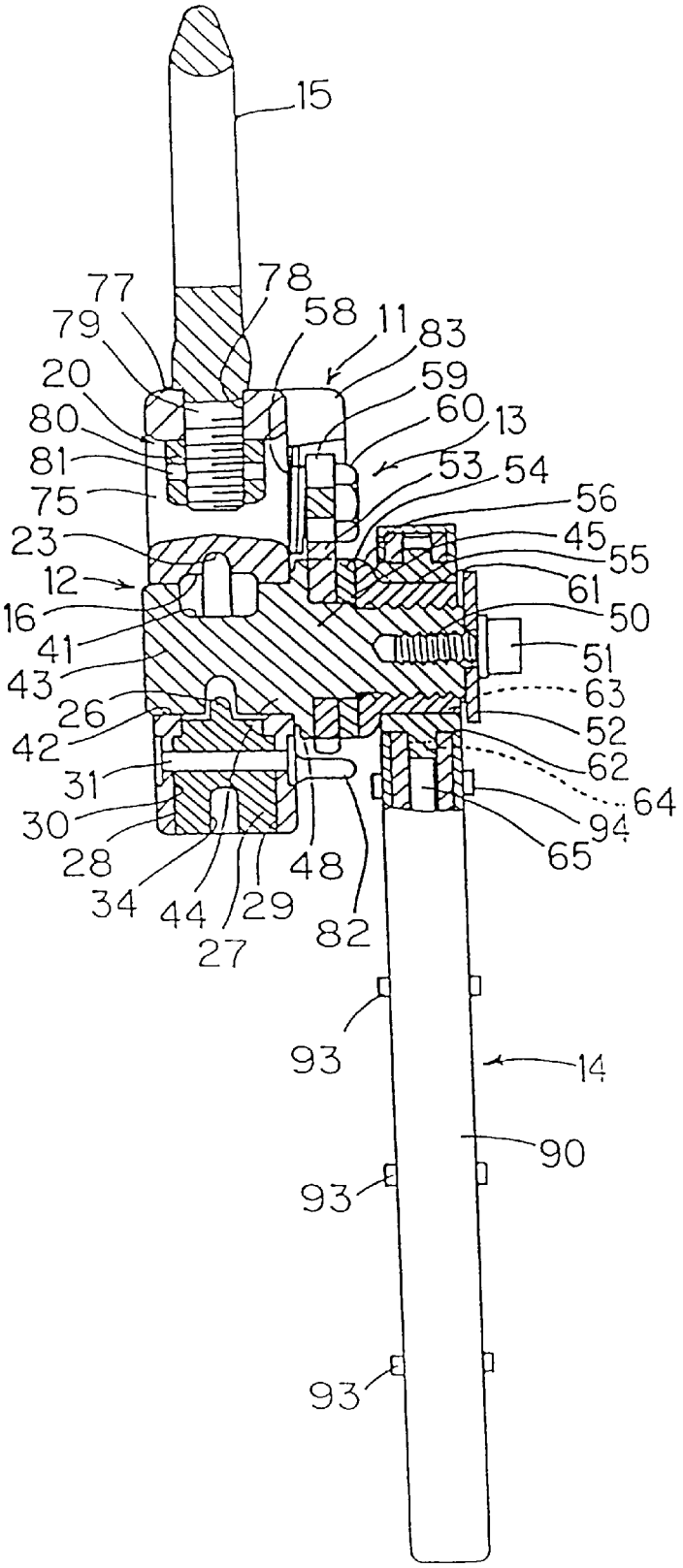
FIG. 2 is a sectional view taken on line 2—2 of FIG. 1.

FIG. 1 is a front view of a hoist and traction apparatus showing one embodiment of the invention and FIG. 2 is a sectional view taken on line 2—2 of FIG. 1. The hoist and traction apparatus in the illustrated embodiment is given a rated load of 150 Kg and has its own weight of 700 g. The hoist and traction apparatus comprises a body 11 which is formed into a small-sized cube of 68 mm high, 42 mm wide, and 20 mm thick to be so compact and lightweight that it can be grasped or held with one hand. In the body 11, a load sheave 12, a mechanical brake 13, an operating lever 14 and a hook 15 for hanging the body 11 are fitted.

Figure 3:
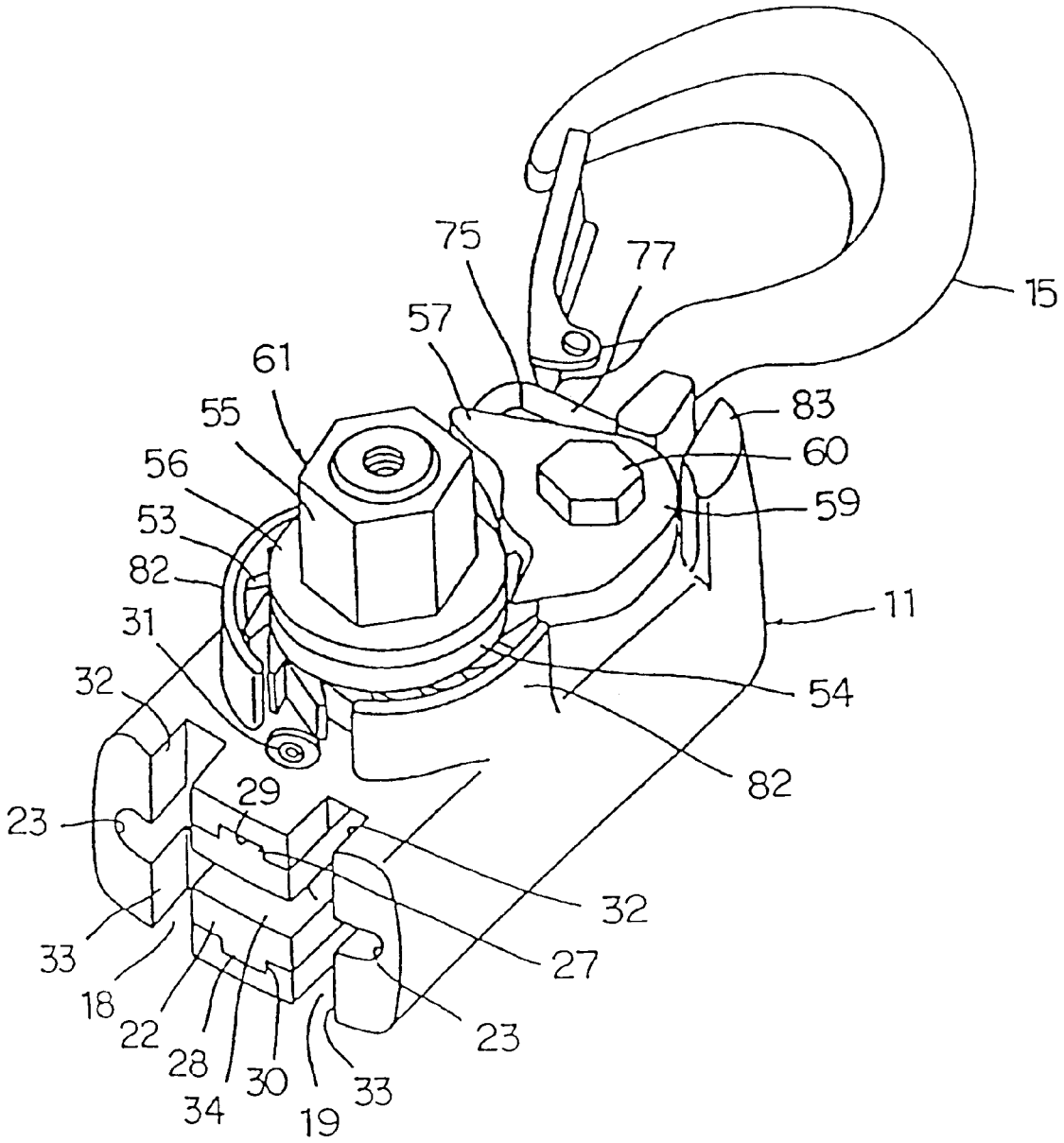
FIG. 3 is a perspective view of the hoist and traction apparatus from which an operating lever is removed.
Figure 4:
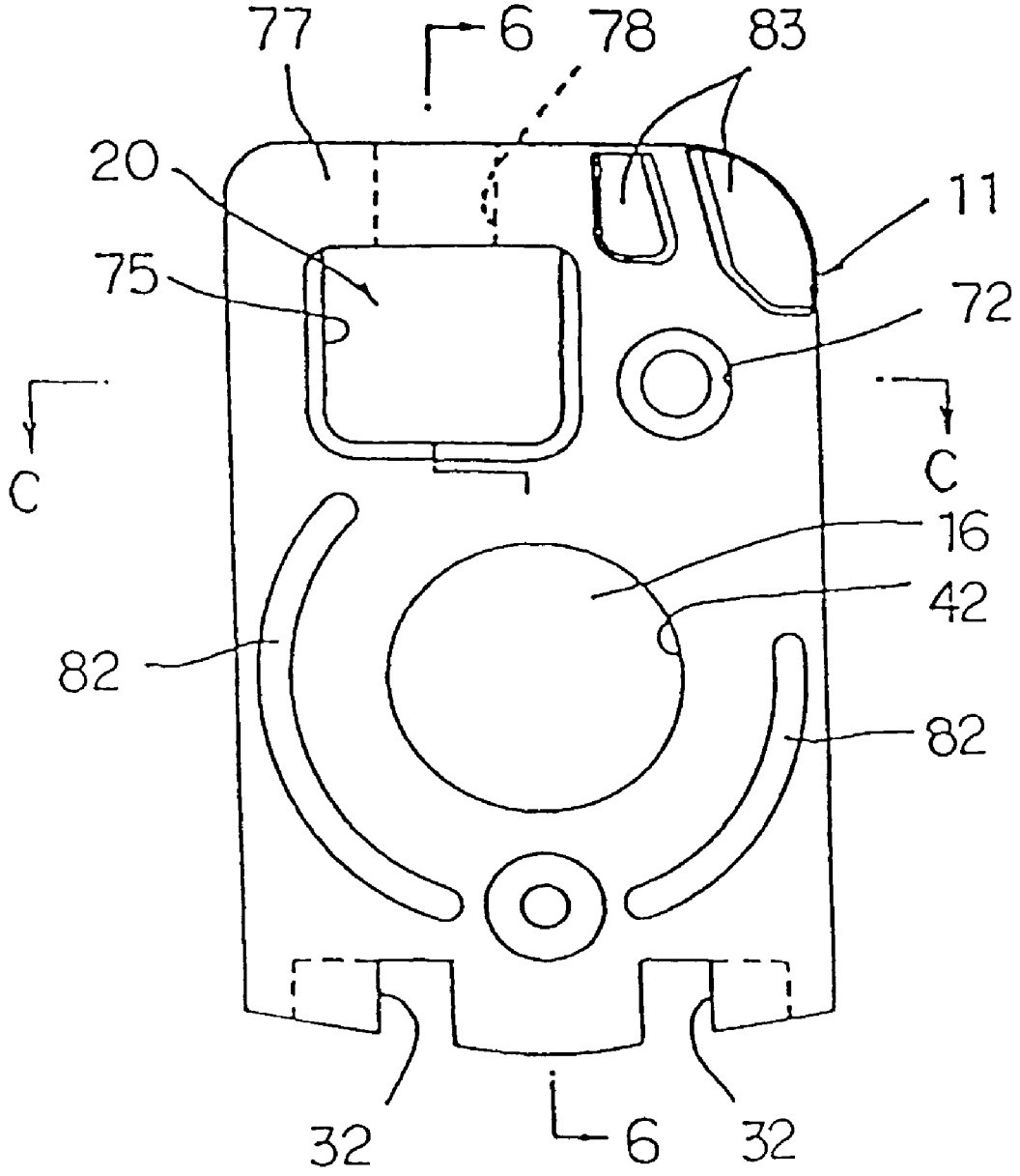
FIG. 4 is a front view of the body of the hoist and traction apparatus of FIG. 1.
Figure 5:
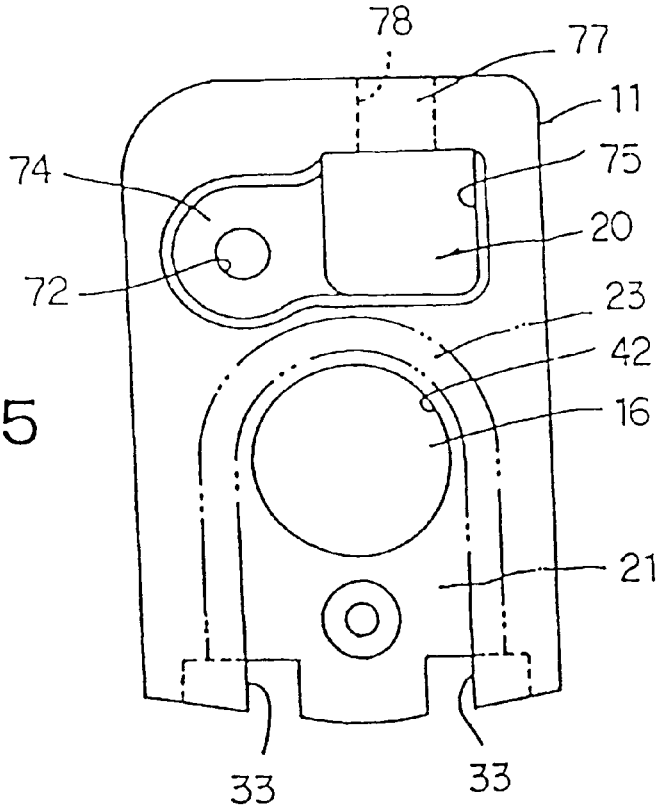
FIG. 5 is a rear view of the body of the hoist and traction apparatus of FIG. 1.
Figure 6:
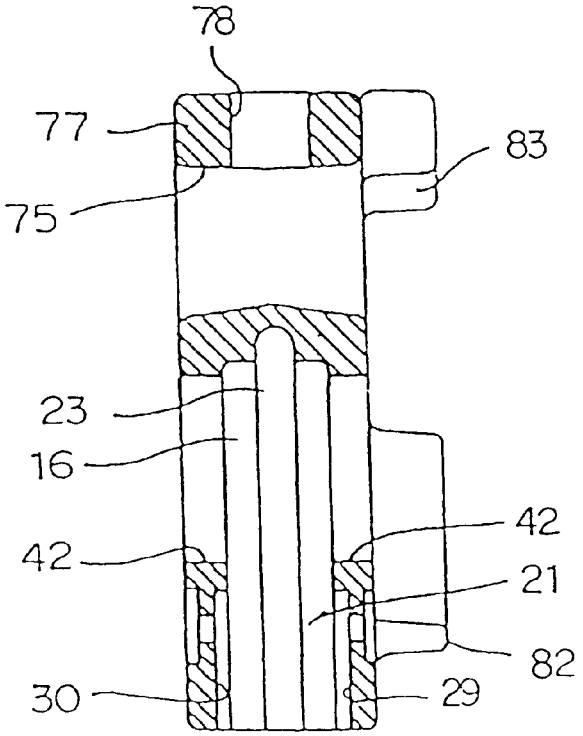
FIG. 6 is a sectional view taken on line 6—6 of FIG. 4.
Figure 7:
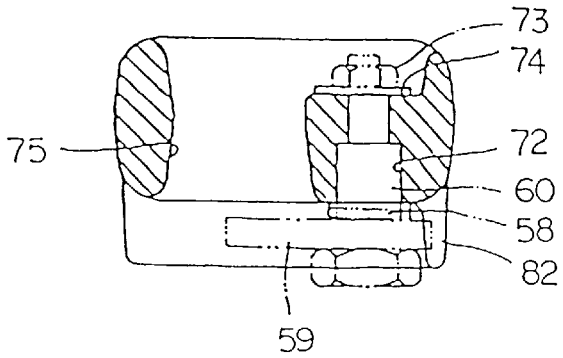
FIG. 7 is a sectional view taken on line 7—7 of FIG. 4.
Figure 8:
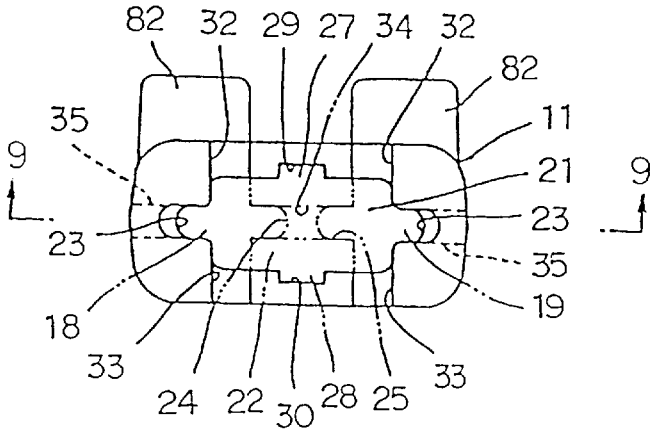
FIG. 8 is a bottom view of the body of the hoist and traction apparatus of FIG. 1.
Figure 9:
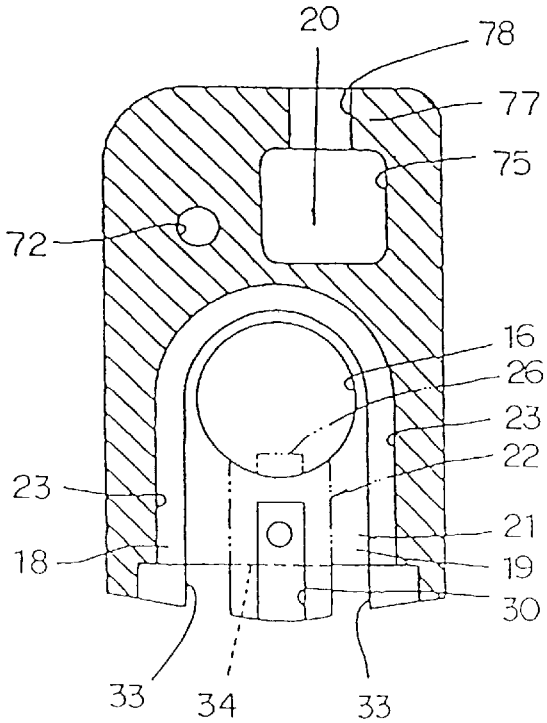
FIG. 9 is a sectional view taken on line 9—9 of FIG. 8.

FIG. 3 is a perspective view of the hoist and traction apparatus from which the operating lever is removed; FIG. 4 is a front view of the body; FIG. 5 is a rear view of the body; FIG. 6 is a sectional view taken on line 6—6 of FIG. 4; FIG. 7 is a sectional view taken on line 7—7 of FIG. 4; FIG. 8 is a bottom view of the body; and FIG. 9 is sectional view taken on line 9—9 of FIG. 8. With reference to FIGS. 3 through 9, an explanation on the body 11 is given below.

The body 11 is molded by aluminum die-casting mainly employing aluminum alloy. The body 11 includes a load sheave accommodating part 16 penetrating widthwise of the body 11 and inserting the load sheave 12 therein; chain guide passages 18, 19 which communicate with the load sheave accommodating part 16 at its one end and opens to outside at the other end for guiding a load chain 17 passing over the load sheave 12; and a hook mounting portion 20 at which a hook 15 is mounted, all of which are integrally formed with the body 11, as shown in FIGS. 4 through 9. The construction in which the load sheave accommodating part 16, the chain guide passages 18, 19 and the hook mounting portion 20 are integrally formed with the body 11 requires no particular parts for fitting these to the body, thus achieving costs reduction and downsizing of the apparatus. Also, since this constructed body 11 can be readily formed by the aluminum die casting, weight reduction of the apparatus can also be achieved. Further, the body 11 can be formed into a suitable form and size to be grasped with one hand, thus providing an improved operability in hoisting and lowering a load.

Further, in the body 11, an opening 21 communicating with the load sheave accommodating part 16 to open the load sheave accommodating part 16 to outside is formed. On both widthwise side surfaces of the opening 21 and an inner periphery of the load sheave accommodating part 16, a link guide groove 23 for guiding vertical links of the load chain 17 is formed to extend continuously. This construction, in which the opening 21 communicating with the load sheave accommodating part 16 to open the same 16 to outside is formed in the body 11, can provide the advantage that when the body 11 is formed by an aluminum die casting, a molding tool therefor can be simplified to reduce manufacturing costs.

Further, the chain guide 22 for guiding the load chain 17 into and from the load sheave 12 is fixed in the opening 21 so that the chain guide passages 18, 19 can be defined at both sides of the chain guide. This arranged chain guide 22 enables the load chain 17 to be smoothly guided to the chain guide passages 18, 19 to ensure the smooth driving operations of the load sheave 12.

Figure 10:
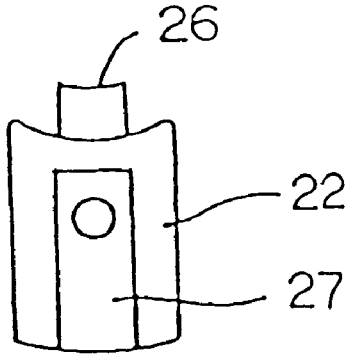
FIG. 10 is a front view of a chain guide.
Figure 11:
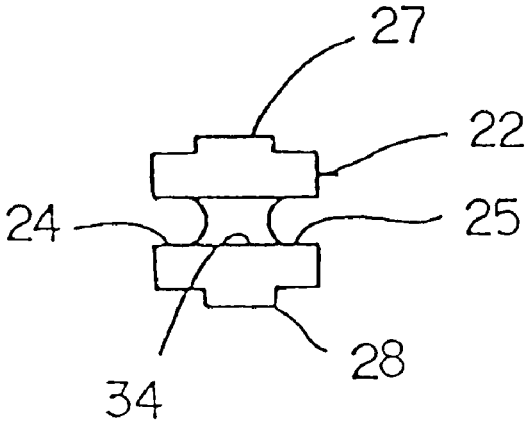
FIG. 11 is a bottom view of the chain guide.

FIG. 10 is a front view of the chain guide 22 and FIG. 11 is a bottom view of the same. With reference to FIGS. 8 and 11, an explanation of the chain guide 22 is given below.

As shown in FIGS. 8 and 11, the chain guide 22 is provided, at both widthwise sides thereof, with link guide grooves 24, 25 to confront link guide grooves 23 provided at both widthwise sides of the opening 21 so that when the chain guide 22 is fixed in the opening 21 at the open end, cross-shaped regulation holes can be defined in the chain guide passages 18, 19. Further, the chain guide 22 is provided at its top with a chain entanglement preventing projection 26 for allowing the load chain 17 to be smoothly disengaged from the load sheave 12. In addition, the chain guide 22 is provided with a pair of fitting projections 27, 28, and the body 11 is provided with fitting grooves 29, 30 in its inner surfaces of a thickness direction of the opening 21. The chain guide 22 is fixed to the body 11 by the fitting projections 27, 28 being fitted into the fitting grooves 29, 30 and a fixing pin 31 piercing the chain guide and the body.

As shown in FIG. 8, the body 11 has a pair of vertical grooves 32, 33 formed at both sides with respect to the thickness direction of the body 11 at open end portions of the chain guide passages 18, 19. Also, the chain guide 22 has, at its outside end, a horizontal groove 34 intersecting the pair of vertical grooves 32, 33 at right angles and being so aligned as to continuously extend between the link guide passages 24, 25.

The body 11 may be provided, at both widthwise sides thereof at the open end of the body 11, with a pair of outer horizontal grooves 35 opposite to the horizontal groove 34, as depicted in a dotted line in FIG. 8.

Figure 12:
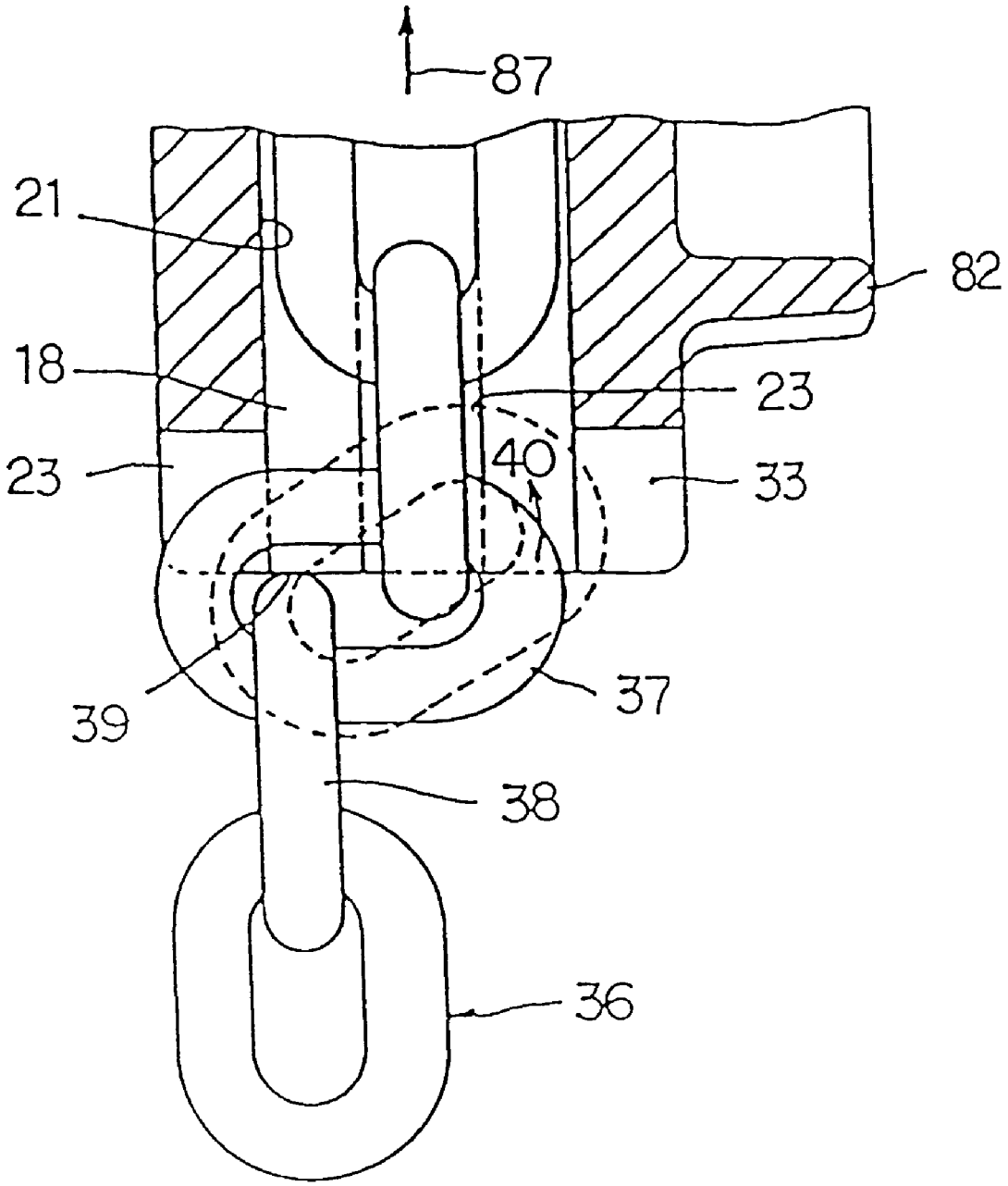
FIG. 12 is an illustration of one example of a twisted state of the load chain trying to go into the chain guide passage.
Figure 13:
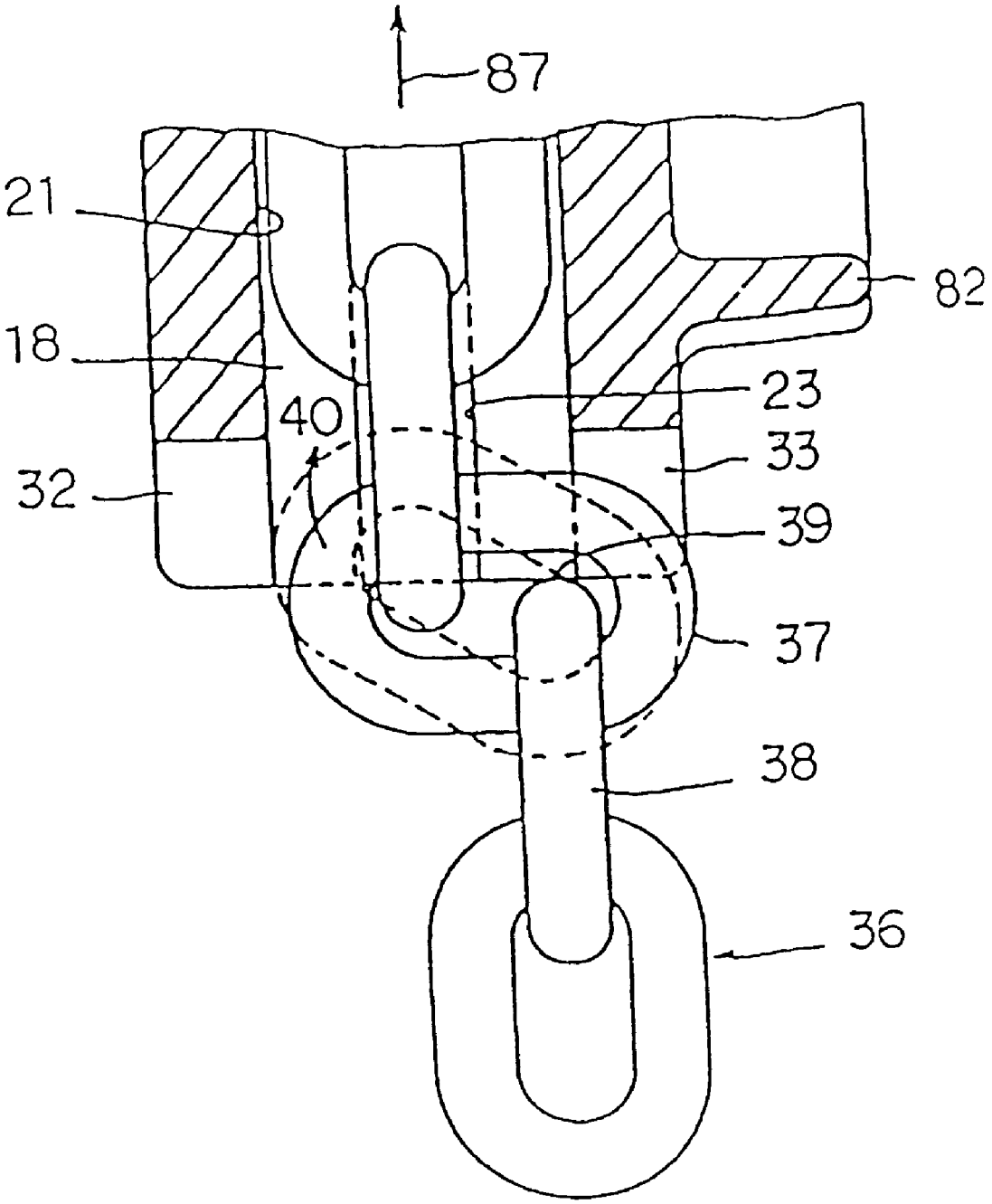
FIG. 13 is an illustration of another example of a twisted state of the load chain trying to go into the chain guide passage.

As shown in FIGS. 12 and 13, when the load chain 17 tries to go into the chain guide passage 18 in a twisted state in which a chain link 37 of the chain 36 is out of position, the out-of-position chain link 37 goes into one of the pair of vertical grooves 32 and 33 or the horizontal groove 34 not shown and a front edge of the next link 38 behind the link 37 comes into engagement in the one of the pair of vertical grooves 32 and 33 or in the horizontal groove 34. As the chain 37 is pulled toward the load sheave 12 or in the direction indicated by an arrow 87 in FIGS. 12 and 13 by the drive of the load sheave 12, the out-of-position chain link 37 is forced to turn on an engagement point 39 in the direction indicated by an arrow 40 in FIGS. 12 and 13 by the pulling force and is guided into the chain guide passage 18 with being corrected in posture as shown in a dotted line. Thus, the pair of vertical grooves 32, 33 and the horizontal groove 34 allow a twisted or kinked load chain 17 to be straightened out. Also, since the pair of vertical grooves 32, 33 and the horizontal groove 34 are all provided at the end portion of the body 11 on the opening side, no particular members are required to untangle twist in the load chain 17, thus achieving reduction in size, weight and costs of the apparatus.

Also, as shown in FIGS. 1, 4 and 7, the hook mounting part 20 in the body 11 has, at a place in an upper part of the body 11 isolated from the load sheave accommodating part 16, a penetration part 75 penetrating widthwise of the body 11 and an insertion hole 78 bored in a top wall 77 of the penetration part 75 to communicate the upper wall of the body 11 with the top wall of the penetration part 75. The hook 15 has at its lower end portion a mounting shaft 79 for the hook 15 to be fixed to the body 11, and the mounting shaft 79 has a threaded portion at the end portion thereof. After the mounting shaft 79 of the hook 15 is inserted into the insertion hole 78, a nut 80 of a fixing member inserted in the penetration part 75 is screwed to the threaded portion at the end portion of the shaft 79 and is fixed by a split pin 81, whereby the hook 15 is rotatably supported to the body 11. This structure in which the hook 15 is supported to the body 11 at the penetration part 75 of the body 11 enables the hook 15 to be held with a simple structure without reducing the strength of the body 11, thereby achieving reductions in size, weight and costs.

Figure 14:
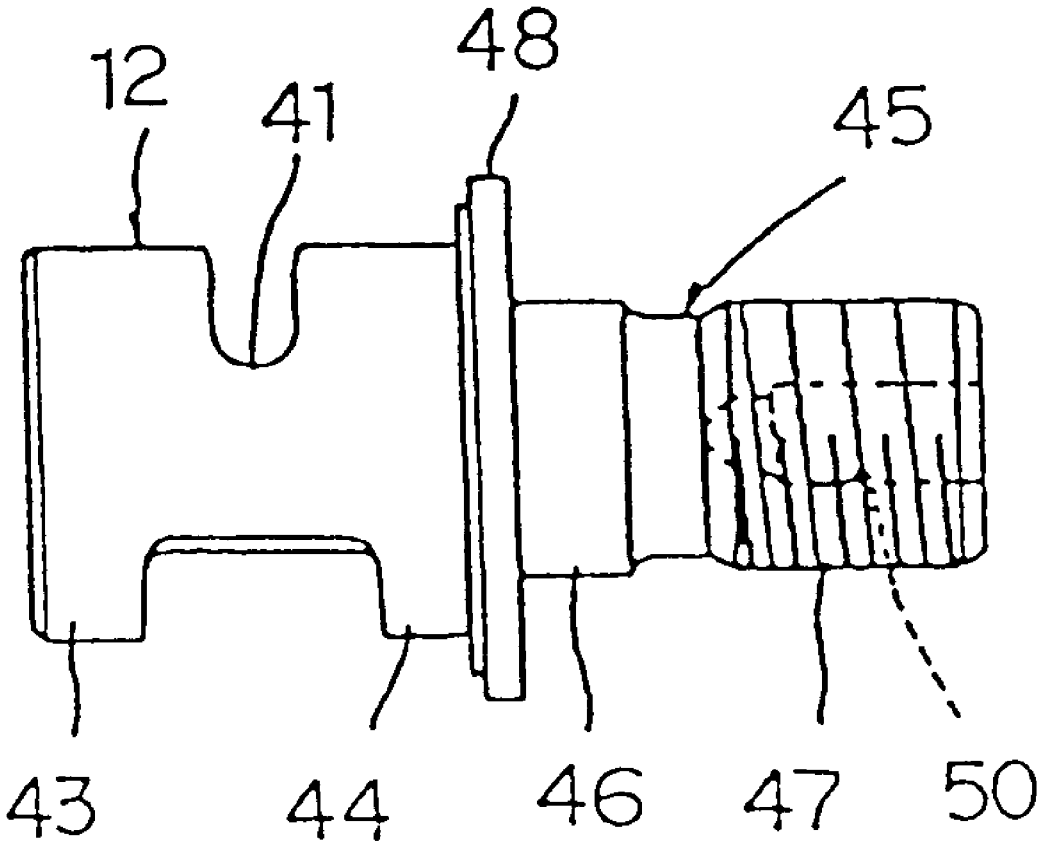
FIG. 14 is a front view of the load sheave.

FIG. 14 is a front view of the load sheave 12. As shown in FIG. 14, the load sheave 12 accommodated in the load sheave accommodating part 16 of the body 11 includes a chain engaging groove 41 formed on the periphery thereof; a pair of shaft portions 43, 44 provided at both sides of the chain engaging groove 41; and a drive shaft 45 formed at the outside of the one shaft portion 44 to be integral with the load sheave 12. The arrangement of the drive shaft 45 integrally formed with the load sheave 12 can provide the advantage of reducing parts count and costs.

As shown in FIGS. 2, 4 and 6, the body 11 is provided with shaft bores 42 which are formed to be continuous to both sides of the load sheave accommodating part 16 in a widthwise direction of the body 11, so that the shaft portions 43, 44 of the load sheave 12 are rotatably supported. The load sheave 12 is inserted in the load sheave accommodating part 16, as shown in FIG. 2 and is held to the body 11 by means of the load chain 17 inserted into the link guide passage 23 from either of the chain guide passages 18, 19 to be wound around the load sheave 12, though not shown in FIG. 2. Thus, no particular parts are needed for holding the load sheave 12 to the body 11, thus achieving the simplified structure and the lightweight and the costs reduction.

As shown in FIG. 14, the drive shaft 45 has a circular shaft portion 46, a threaded portion 47 and a disc-like driven member 48 which is non-rotatable relative to the drive shaft 45 and is integrally formed with a base of the circular shaft portion 46 and projected therefrom. In an axial end of the threaded portion 47 of the drive shaft 45, a threaded bore 50 is provided. On the circular shaft portion 46 at the outside of the driven member 48, a reverse rotation stop gear 53 is so supported as to be rotatable relative to the drive shaft 45. Further, on the circular shaft portion 46 at the outside of the reverse rotation stop gear 53, a disc-like lining plate 54 is supported so as to be rotatable relative to the drive shaft 45 in the same manner as the reverse rotation stop gear 53.

Further, as shown in FIG. 2, a driving member 55 having a flange 56 is screwed with the threaded portion 47 of the drive shaft 45 at the outside of the lining plate 54, and a washer 52 having a larger diameter than the threaded portion 47, which serves as a slip-out preventing member, is fixed at the outside of the driving member 55 by screwing a bolt 51 into the threaded bore 50.

As shown in FIGS. 4 and 5, a shaft bore 72 penetrating the body 11 widthwise thereof is bored in an upper portion of a side wall of the body 11, and a pawl shaft 60 composed of a stepped bolt having a hexagonal head is inserted into the shaft bore 72 from one side of the body 11 and is fixed to the body 11 by tightening a nut 73 screwed with an end portion of the inserted pawl shaft, as shown in FIG. 7. Further, a recessed seat 74 for the nut 73 is formed in a side surface of the body 11 on the side of the nut being tightened so that the nut 73 can be prevented from being projected beyond the side surface of the body 11 on the side of the nut being tighened. Also, as shown in FIGS. 2 and 7, a reverse rotation stop pawl 59 having an operation portion 57 is supported on the pawl shaft 60 with being biased toward the reverse rotation gear 53 by a pawl spring 58 interposed between the side wall of the body 11 and the reverse rotation pawl 59.

The mechanical brake 13 is composed of this constructed, driven member 48, reverse rotation stop gear 53, lining plate 54, driving member 55 and reverse rotation stop pawl 59.

It is noted that the construction mentioned above, in which the driven member 48 is integrally formed with the drive shaft 45 and the reverse rotation gear 53 and the lining plate 54 are supported on the circular shaft portion 46, may be modified such that the driven member 48 is separately formed to have a cylindrical boss and is connected with the drive shaft 45 by means of a serration and the like so that it is non-rotatable relative to the drive shaft 45, and the reverse rotation gear 53 and the lining plate 54 are supported on the cylindrical boss of the driven member 48. Further, in addition to the lining plate 54 interposed between the reverse rotation stop gear 53 and the flange 56 of the driving member 55, another lining plate may be interposed between the reverse rotation stop gear 53 and the driven member 48.

As shown in FIG. 3, the driving member 55 has a boss having a hexagonal profile as a non-circular configured part 61 so that a ratchet wheel 62 of the operating lever 14 as will be described next can be fitted onto the non-circular configured part 61 of the boss.

Figure 15:
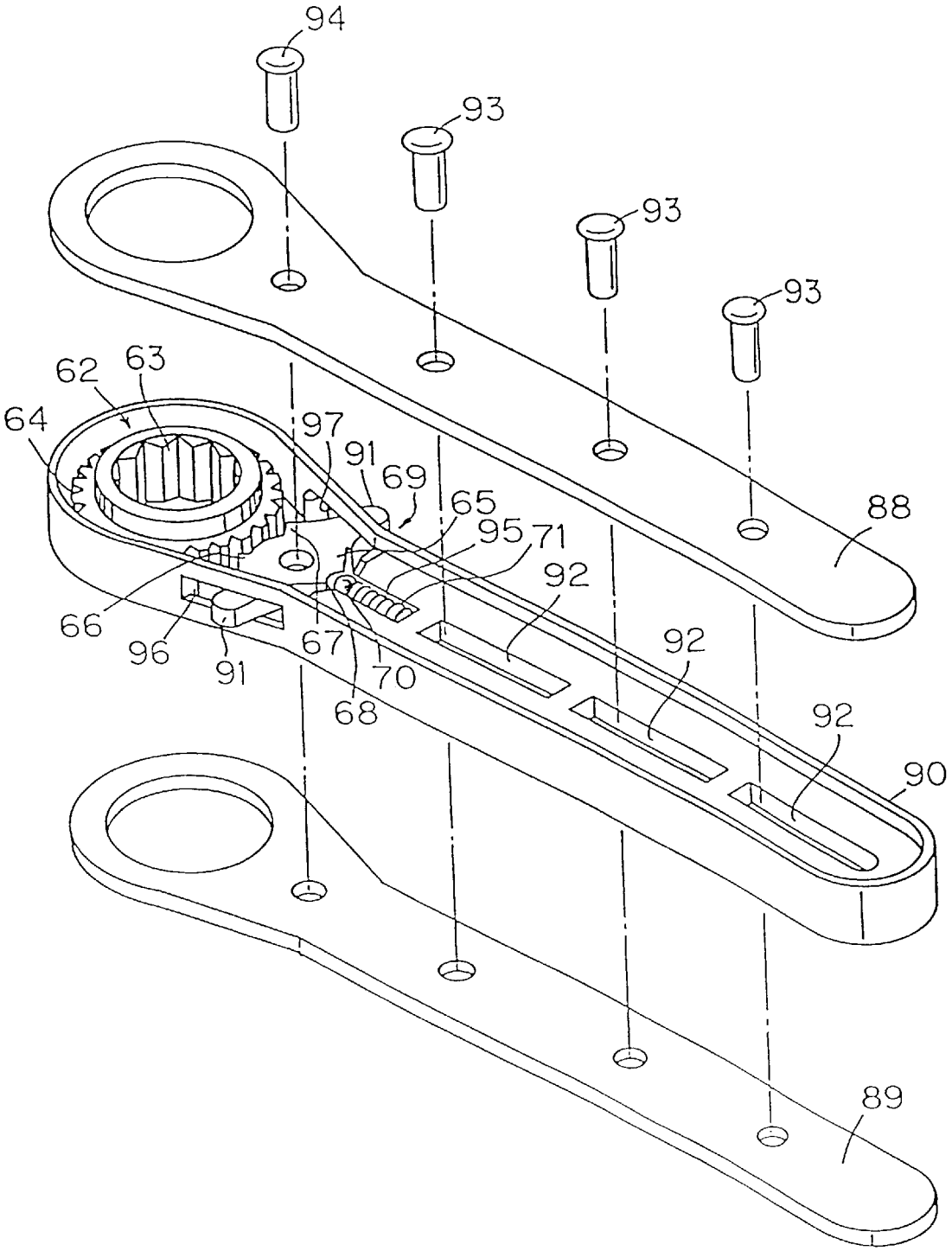
FIG. 15 is a perspective view showing the inner structure of the operating lever.

FIG. 15 is a perspective view showing the inner structure of the operating lever 14. With reference to FIGS. 1, 2 and 15, the explanation of the operating lever 14 is given below.

The operating lever 14 includes a pair of side plates 88, 89 an d a frame 90 for enclosing the pair of side plates at their margins. In the inside of the frame 90 are housed a ratchet wheel 62, a feed paw 65 engageable with the ratchet wheel 62, a spring 71 for biasing the feed pawl 65 toward ratchet wheel 62, and a ball 70 interposed between the feed pawl 62 and the spring 71.

The ratchet wheel 62 has at its center a non-circular fitting hole in the form of a dodecagonal fitting hole 63 in which the non-circular configured part 61 of the boss of the driving member 55 is fitted to be non-rotatable relative thereto and a transmission tooth 64 formed around the fitting hole 63. A feed pawl 65 engageable with the transmission tooth 64 to propel the ratchet wheel 62 in the normal direction and in the reverse rotation is disposed at a radially outward position of the ratchet wheel 62. The feed pawl 65 includes a normal engagement projection 66 which is engaged with the transmission tooth 64 to transmit the drive of the operating lever 14 to the driving member 55 only when the ratchet wheel 62 is rotated in the normal rotation direction (in the winding direction); a reverse engagement projection 67 which is engaged with the transmission tooth 64 to transmit the drive of the operating lever 14 to the driving member 55 only when the ratchet wheel 62 is rotated in the reverse rotation direction (in the unwinding direction); and a free rotation permitting cavity 68 for allowing the feed pawl to be positioned at a free rotation position at which the feed pawl is not engaged with the ratchet wheel in either of the normal or reverse directions. Also, the feed pawl 65 is provided at both ends thereof with switching operation portions 91 for switching the feed pawl 65. Further, the ball 70 and the spring 71 are located at a position opposite to the side of the feed pawl 65 confronting the ratchet wheel 62.

The pair of side plates 88, 89 are fixed to the frame 90 by fixing pins 93 extending through lightening holes 92 in the frame 90, with frame 90 sandwiched between the side plates 88, 89. With the riveting of the fixing pins 93, the ratchet wheel 62 is rotatably supported with sandwiched between the pair of side plates 88, 89, and the feed pawl 65 is so supported between the pair of side plates 88, 89 as to pivot on one fixing pin 94 of the fixing pins 93. The frame 90 includes a spring accommodating portion 95 for accommodating the spring 71 and windows 96, 97 for letting the switching operation portions 91 of the feed pawl 65 out, the spring accommodating portion 95 and the windows 96, 97 being integrally formed in the frame 90. The spring 71 is housed in the spring accommodating portion 95, and the switching operation portions 91 of the feed pawl 65 are so assembled as to be let out from the windows 96, 97.

The switching means 69 is composed of the normal engagement projection 66, the reverse engagement projection 67 and the free rotation permitting cavity 68 which are integrally formed with the feed pawl 65. The switching operation portions 91 of the feed pawl 65 are operated to selectively switch the feed pawl 65 to the normal engagement position at which the feed pawl 65 is engaged with the transmission tooth 64 to propel the ratchet wheel 62 in the normal direction, the reverse engagement position at which the feed pawl 65 is engaged with the transmission tooth 64 to propel the ratchet wheel 62 in the reverse direction or the free rotation position at which the feed pawl 65 are not engaged with the transmission tooth 64 to propel the ratchet wheel 62 in neither of the normal and reverse directions. This construction provides the advantage that the operating lever 14 having the switching means 69 can be realized with a simple structure, and also since the spring accommodating portion 95 and the windows 96, 97 are integrally formed in the frame 90, parts count can be reduced to manufacture the operating lever with ease and at reduced costs.

In addition, attachment and support of the operating lever 14 to the driving member 55 can be readily performed by simple engagement of the non-circular fitting hole 63 with the non-circular configured driving member 55. This enables the operating lever 14 to be combined as a unit to be compact, thus providing an improved assembly together with achieving reduction of the size of the whole apparatus. In the embodiment as illustrated in FIGS. 1 and 2, after the operating lever 14 is fitted on the driving member, the washer 52 serving as a slip-out preventing means is fixed by the bolt 51 screwed into the threaded bore 50, so that the operating lever 14 is prevented from being erroneously slipped out of the driving member 55.

Figure 16:
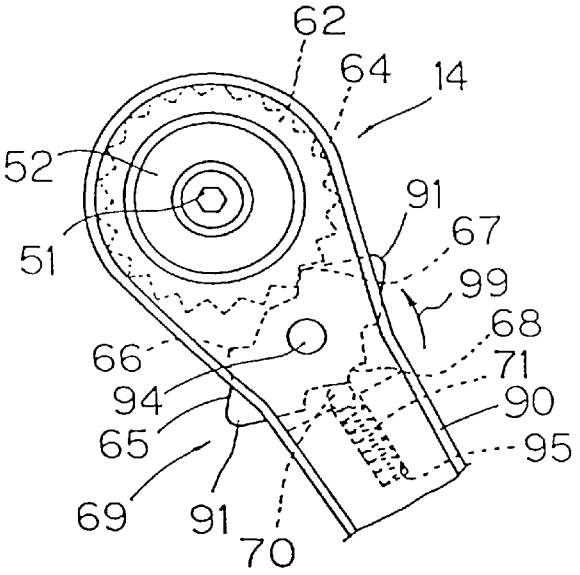
FIG. 16 is an illustration mainly showing the state in which a feed pawl is put in its reverse engagement position.
Figure 17:
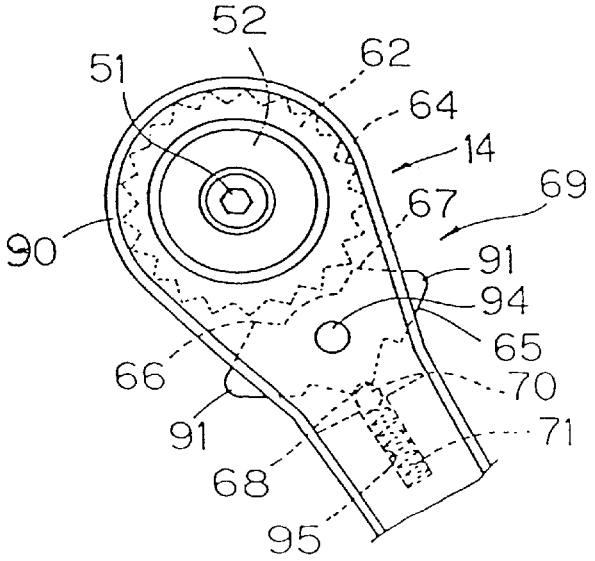
FIG. 17 is an illustration mainly showing the state in which the feed pawl is put in its free rotation position.

Next, with reference to FIGS. 1, 16 and 17, an explanation on the feed pawl 65 switched to the normal engagement position, the reverse engagement position or the free rotation position.

FIG. 1 shows that the feed pawl 65 is in the normal engagement position. The switching operation portion 91 projecting to the left side as viewed in FIG. 1 is pushed with a hand in the direction indicated by an arrow 98 to engage the normal engagement projection 66 of the feed pawl 65 with the transmission tooth 64 of the ratchet wheel 62, and thereby the feed pawl 65 is placed in the normal engagement position. The feed pawl 65 placed in the normal engagement position is held by the biasing force of the spring 71 applied to the feed pawl 65 by means of the ball 70. FIG. 16 shows that the feed pawl 65 is in the reverse engagement position. The switching operation portion 91 projecting to the right side as viewed in FIG. 16 is pushed with a hand in the direction indicated by an arrow 99 to engage the reverse engagement projection 67 of the feed pawl 65 with the transmission tooth 64 of the ratchet wheel 62, and thereby the feed pawl 65 is placed in the reverse engagement position. The feed pawl 65 placed in the reverse engagement position is held by the biasing force of the spring 71 applied to the feed pawl 65 by means of the ball 70. FIG. 17 shows that the feed pawl 65 is in the free rotation position. The feed pawl 65 is placed in an intermediate position between the normal engagement position and the reverse engagement position so that neither of the normal engagement projection 66 nor the reverse engagement projection 67 can be brought into engagement with the transmission tooth 64 of the ratchet wheel 62. The feed pawl 65 placed in this position is held by the biasing force of the spring 71 applied to the feed pawl 65 by means of the ball 70 caught in the free rotation permitting cavity 68.

As shown in FIGS. 3 and 4, the body 11 is provided, on a side wall thereof, with an arch-like first protection 82 located around the reverse rotation stop gear 53 and projecting axially outwardly therefrom to encircle the reverse rotation stop gear 53. The first protection 82 is integrally formed with the body 11. With the provision of the first protection 82, an operator's hand grasping the body 11 can be held on the side wall of the first protection 82 to be protected from coming into contact with the reverse rotation stop gear 53, thus achieving smooth driving operations of the load sheave with the firmly grasping of the body.

Further, the body 11 is provided, on the side wall thereof, with a second protection 83 located at a position outside of the reverse rotation stop pawl 59 and projecting axially outwardly beyond the reverse rotation stop pawl 59. The second protection 83 is divided into two, as shown in FIG. 1, between which one of spring legs of the pawl spring 58 is retained. The other spring leg of the pawl spring 58 is retained at an inner side of the operating portion 57 of the reverse rotation stop pawl 59. Though a coiled portion of the pawl spring 58 coiled around the boss of the reverse rotation stop pawl 59 is exposed to outside, both tips of the spring legs of the pawl spring 58 are adapted not to project beyond the outside surface of the body 11. With the provision of the second protection 83, the operator's hand grasping the body 11 can be held on the side wall of the second protection 83 and prevented from coming into contact with the reverse rotation stop pawl 59. This can provide the advantage that the reverse rotation stop pawl 59 can be avoided being erroneously disengaged from the reverse rotation stop gear 53, while the body 11 is firmly grasped with his hand.

Next, operation of this constructed hoist and traction apparatus is described below.

This constructed hoist and traction apparatus is compact and lightweight and has the mechanical brake 13, so it can be easily handled in hoisting up and down a load, tying a load or tensioning a rope and the like. For example, when the hoist and traction apparatus is used to tie a load, the hook 15 is hooked to a tying member such as a rope or a belt put around a load, and a lower hook 84 fixed on the load chain 17 on the loaded side is hooked to a fixed member such as a hook at a truck's bed directly or indirectly through some separate member. Then, the switching operation portion 91 is operated by hand to put the feed pawl 65 into the normal engagement position and then the operating lever 14 is operated to swing to and fro to take up the load chain 17 on the loaded side, so as to tie the load. At the beginning of this work, if length of the load chain 17 on the loaded side is too long, the load chain 17 on the unloaded side may be pulled in advance to tense up the load chain 17 on the loaded side for acceleration of the work, with the load sheave 12 put into a freely rotatable state by operating the operating portion 57 of the reverse rotation stop pawl 59 to disengage the reverse rotation stop pawl 59 from the reverse rotation stop gear 53. In this case, the feed pawl 65 can be held in the free rotation position by operating the switching operation poriton 91 by hand, to prevent the operating lever 14 from being rotated together with the load sheave 12. Thus, smooth operations can be ensured to achieve an improved workability.

Also, when the load is untied, the switching operation portion 91 is operated by hand to put the feed pawl 65 into the reverse engagement position and then the operating lever 14 is operated to swing to and fro to loosen the load chain 17 on the loaded side, so as to untie the load. In this case, the load can be gradually untied by the alternate action and inaction of the mechanical brake 13 to prevent load shifting resulting from the load being untied at a stroke.

Further, since the body 11 can be grasped with one hand when the operating lever 14 is operated, stable operation of the operating lever 14 can be achieved, thus improving the operability. Also, since the provision of the first and second protections 82, 83 allow the operator's hand grasping the body to be prevented from coming into contact with the reverse rotation stop gear 53 and the reverse rotation stop pawl 59, smooth operations can be achieved.

Figure 19:
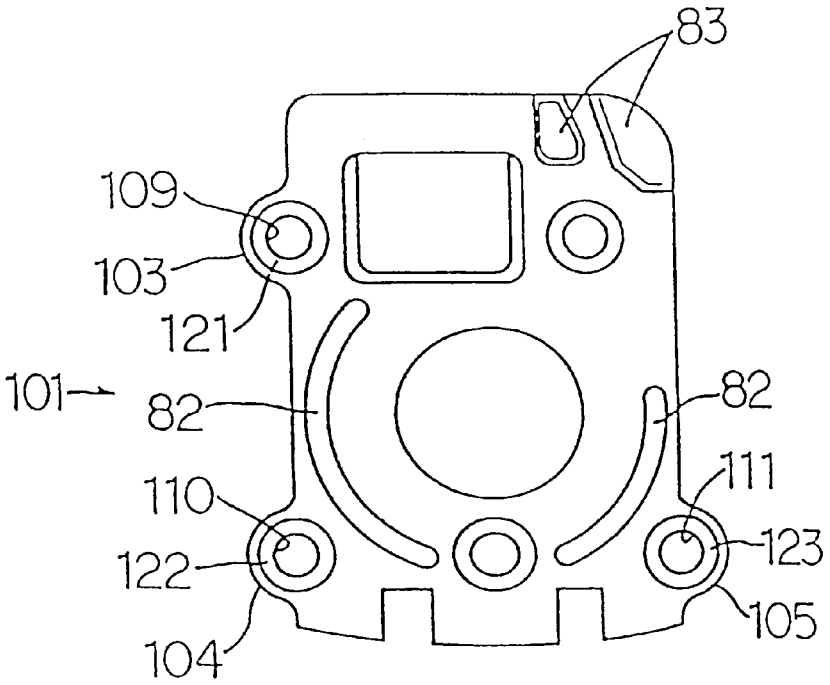
FIG. 19 is a front view of the first split body.
Figure 20:
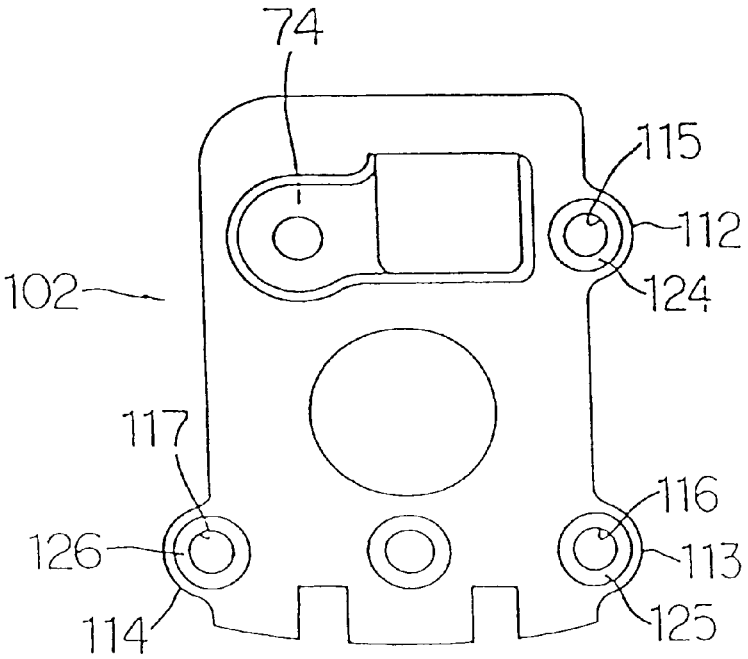
FIG. 20 is a front view of the second split body.
Figure 21:
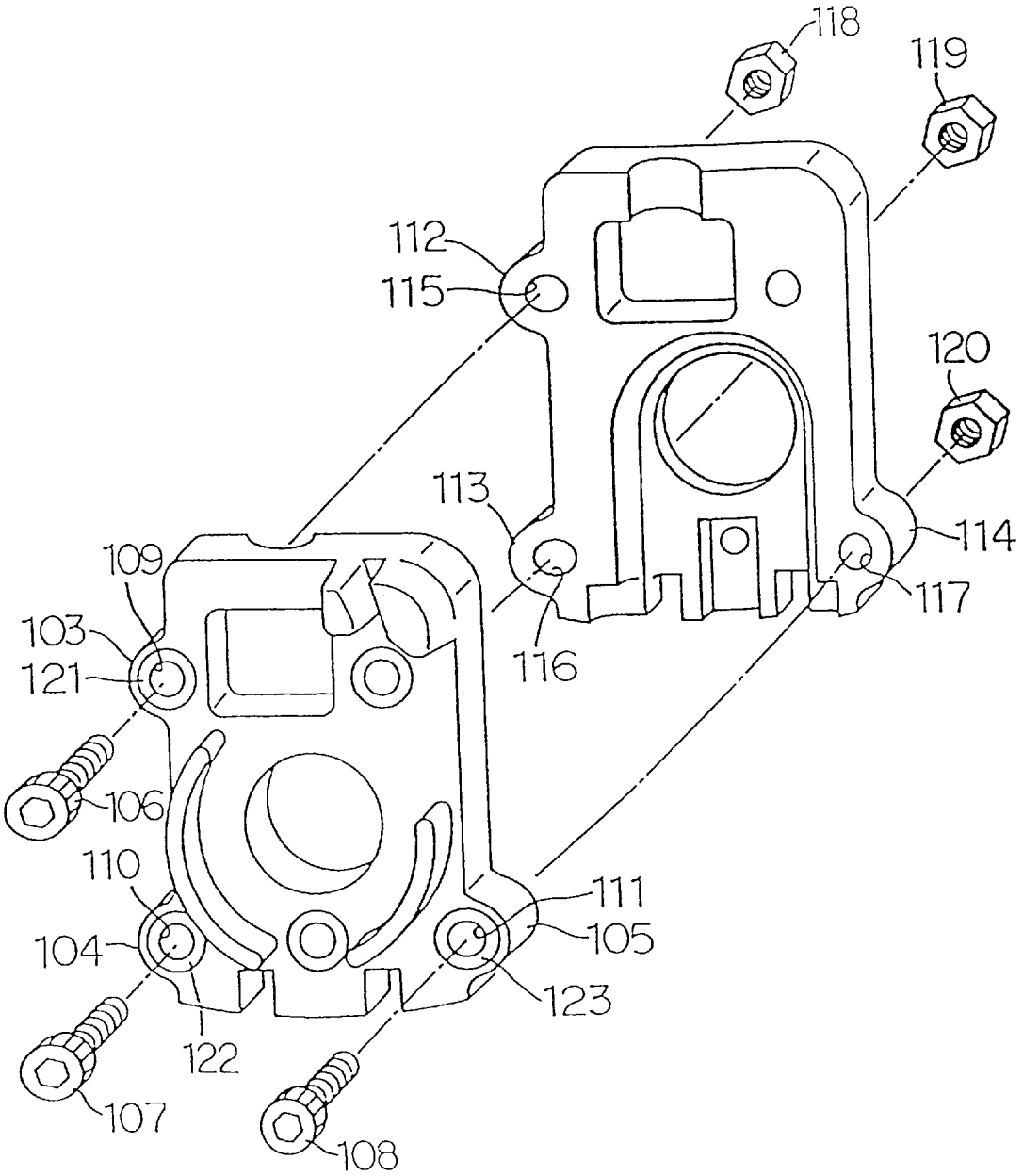
FIG. 21 is an illustration showing the first and second split bodies to be assembled together.

In the embodiment, the body 11 may be modified to be composed of two or more split bodies, e.g. a first split body 101 and a second split body 102. FIG. 19 is a front view of the first split body 101; FIG. 20 is a front view of the second split body 102; and FIG. 21 is an illustration showing the first and second split bodies 101 and 102 to be assembled together. With reference to the FIGS. 19–21, the body 11 modified to be composed of the first split body 101 and the second split body 102 is described below.

In FIGS. 19–21, the first and second split bodies 101 and 102 are composed of two halves into which the body 11 is divided at a widthwise midpoint thereof along a direction substantially orthogonal to the widthwise direction. One of the two halves forming thereon the first protection 82 and the second protection 83 forms the first split body 101 and the other of the two halves forming thereon the recessed seat 74 for the nut 73 threadedly mounted on the pawl shaft 60 forms the second split body 102. As shown in FIG. 19, the first split body 101 is provided, at upper and lower parts thereof at the left hand side, with integrally formed protrusions 103, 104 and at a lower part thereof at the right hand side with an integrally formed protrusion 105. In the protrusions 103, 104 and 105 are formed insertion bores 109, 110 and 111 for bolts 106, 107 and 108 to be inserted therein. As shown in FIG. 20, the second split body 102 is provided, at upper and lower parts thereof at the right hand side, with integrally formed protrusions 112, 113 and at a lower part thereof at the left hand side with an integrally formed protrusion 114. In the protrusions 112, 113 and 114 are formed insertion bores 115, 116 and 117 for the bolts 106, 107 and 108 to be inserted therein. As shown in FIG. 21, the first split body 101 and the second split body 102 are connected back to back so that the protrusions 103, 104 and 105 of the first split body 101 and the protrusions 112, 113 and 114 of the second split body 102 can correspond in position to each other, and then, the bolts 106, 107 and 108 are inserted in the aligned insertion bores 109 and 115; 110 and 116; and 111 and 117, respectively and tightened with nuts 118, 119 and 120, thereby forming the body 11 by the first and second split bodies 101 and 102. By forming the body 11 by the first and second split bodies 101 and 102 like this, the forming of the body 11 can be further simplified. Also, this modification of the body 11 is advantageous in that for example by simply providing an integrally formed protrusion on the end portion of the mounting shaft 79 of the hook 15 and sandwiching the protruded mounting shaft 79 between first and second split bodies 101, 102 when the first and second split bodies 101, 102 are joined together, the hook 15 could be easily fitted to the body 11, without using the nut 80 screwed to the threaded portion at the end portion of the mounting shaft 79 and the split pin 81 for fixing. Thus, in this modification, the assembling of parts into the body 11 can be simplified.

Further, in the protrusions 103, 104 and 105 of the first split body 101, seats 121, 122 and 123 for the bolts 106, 107 and 108 are formed into a recessed shape, and in the protrusions 112, 113 and 114 of the second split body 102, seats 124, 125 and 126 for the nuts 118, 119 and 120 are formed into a recessed shape. The seats 121, 122, 123, 124, 125 and 126 are so recessed as to prevent the bolts 106, 107 and 108 and the nuts 118, 119 and 120 from sticking out of the upper surfaces of the protrusions 103, 104, 105, 112, 113 and 114, so that the body 11 can be grasped firmly and comfortably.

Further, in this modification in which the first and second split bodies 101 and 102 are composed of two halves into which the body 11 is divided at a widthwise midpoint thereof along a direction substantially orthogonal to the widthwise direction, the body 11 may be modified to be composed of three or more split bodies and may be divided into any selected forms. In addition, the protrusions 103; 104; and 105, and 112; 113; and 114 which are provided at three positions on each of the first and second split bodies 101, 102 may be provided at four or more positions on each of the first and second split bodies 101, 102 and the positions are not particularly specified.

Further, the embodiment in which the chain guide 22 is fixed in the opening 21 of the body 11 to define the chain guide passages 18, 19 may be modified such that the chain guide passages 18, 19 are integrally formed with the body without using the chain guide 22.

Figure 18:
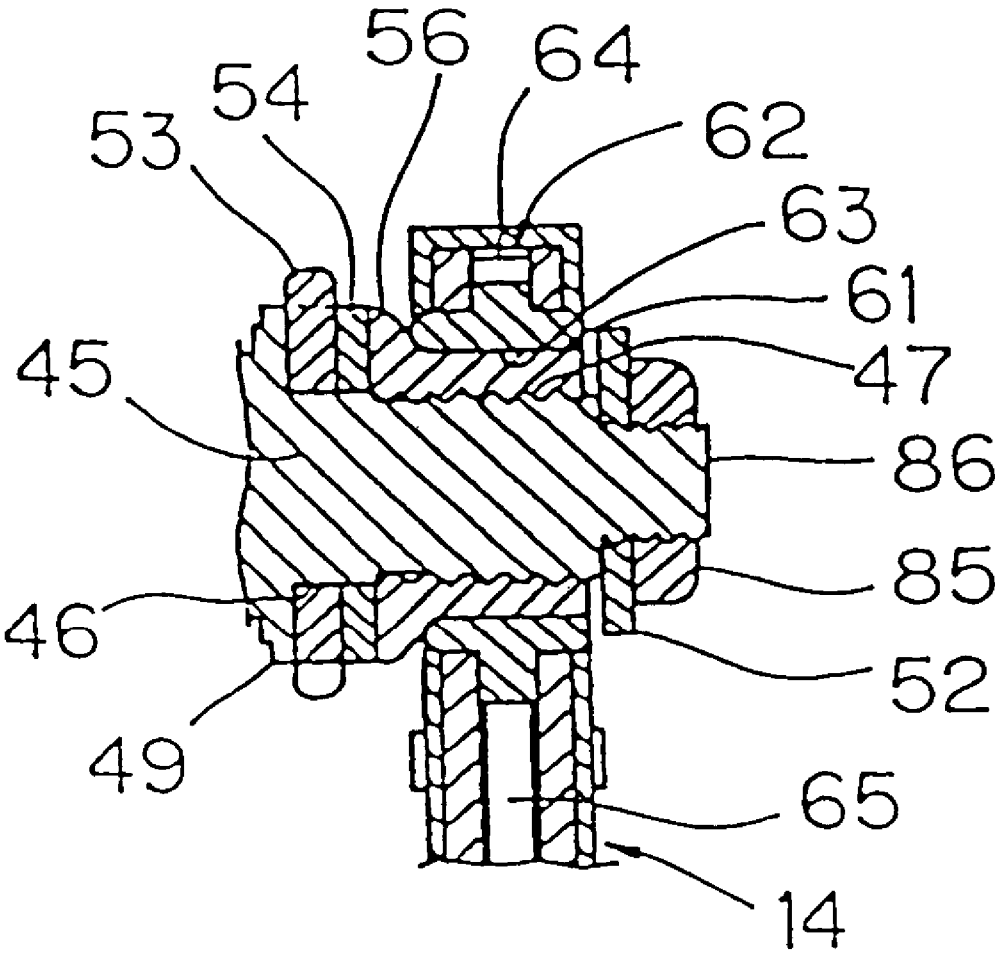
FIG. 18 is a sectional view showing a main part of another example of the structure of an axial end portion of the drive shaft.

Further, the embodiment in which the threaded bore 50 is bored in the threaded portion 47 of the drive shaft 45 and the bolt 51 is screwed into the threaded bore 50 may be modified such that a small-diameter, threaded, coupling shaft portion 86 is provided at an axial end of the threaded portion 47 of the drive shaft 45, and a nut 85 is screwably mounted on the threaded, coupling shaft portion 86, as shown in FIG. 18. In either embodiment, the washer 52 is fixed in contact with the axial end of the threaded shaft 47 so that a clearance for allowing the mechanical brake 13 to be released can be defined between the washer 52 and the driving member 55.

Figure 22:
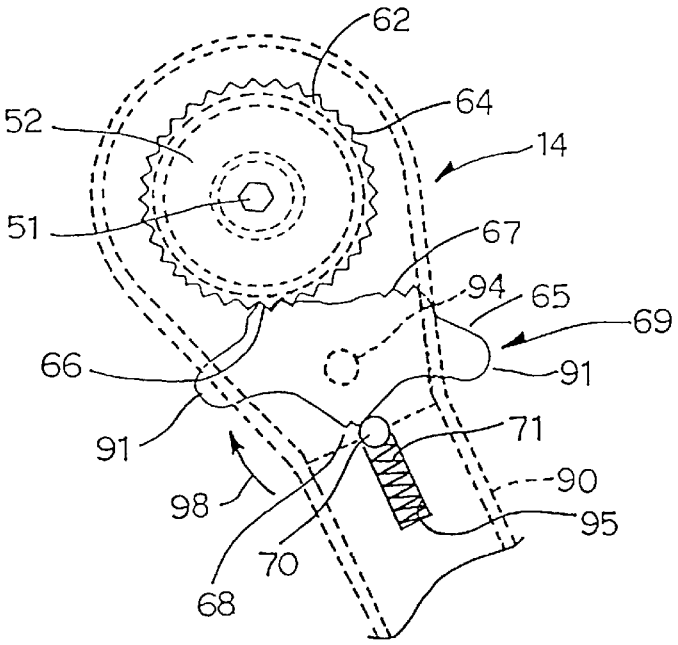
FIG. 22 is an illustration of another example, mainly showing the state in which a feed pawl is put in its normal engagement position.
Figure 23:
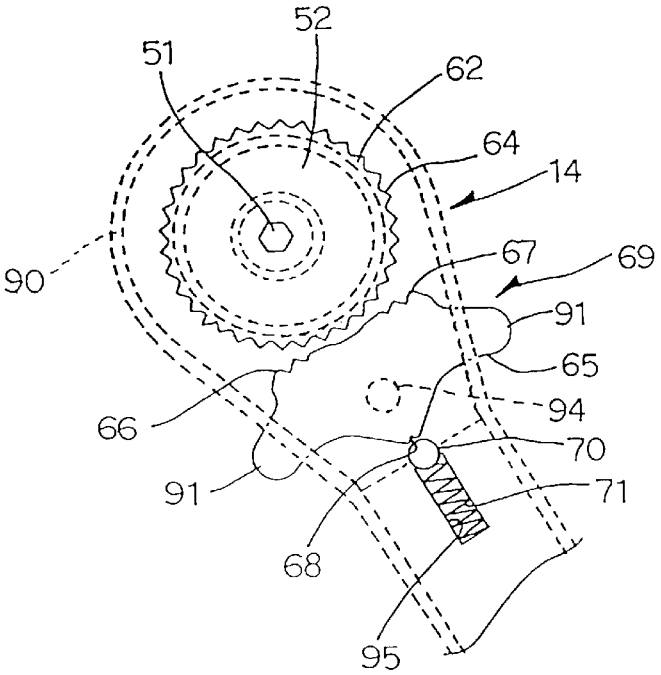
FIG. 23 is an illustration of another example, mainly showing the state in which the feed pawl is put in its free rotation position.
Figure 24:
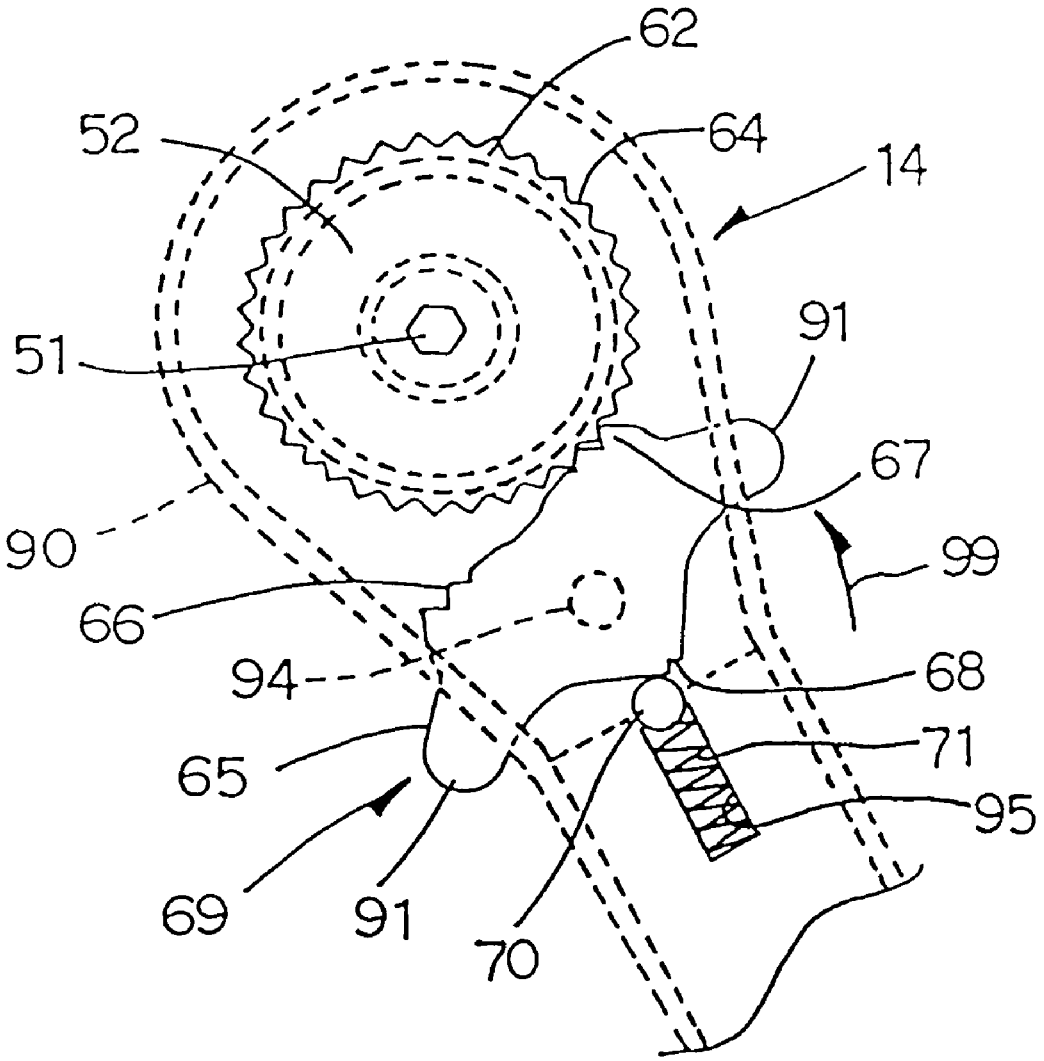
FIG. 24 is an illustration of another example, mainly showing the state in which the feed pawl is put in its reverse engagement position.
Figure 25:
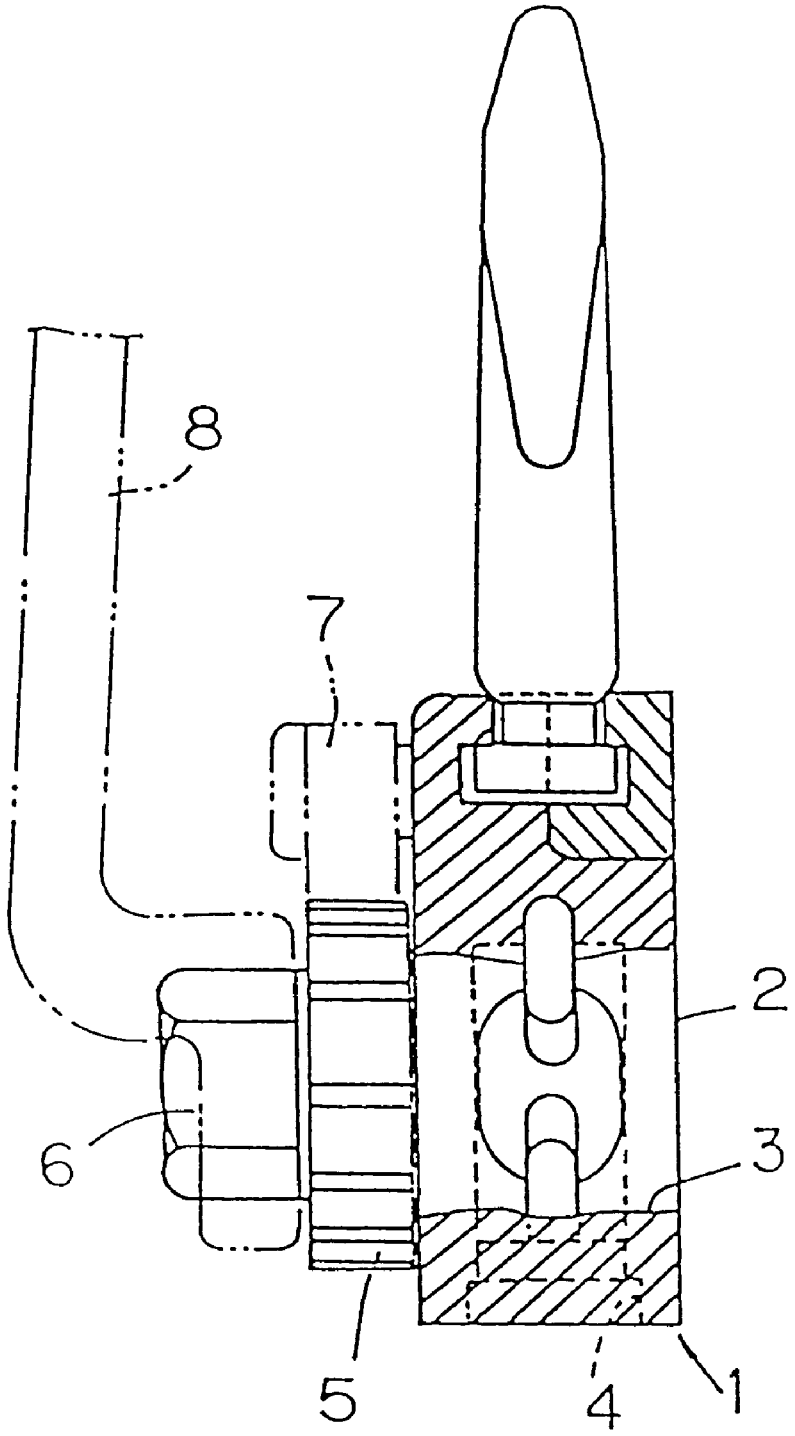
PRIOR ART Fig. 25
FIG. 25 is a side view showing a conventional type hoist and traction apparatus.

In addition, the normal engagement projection 66 and reverse engagement projection 67 of the feed pawl 65, which in the illustration are each formed of a single projection, may be each formed of two projections, for example, as shown in FIGS. 22, 23 and 24. FIG. 22 shows the state of the feed pawl 65 being in its normal engagement position. In the state as shown in FIG. 22, the two projections formed as the normal engagement projection 66 are engaged with the two transmission teeth 64 of the ratchet wheel 62, which enables the engagement between the feed pawl and the ratchet wheel to be more reliable and also enables the driving power to be dispersedly transmitted to the transmission teeth 64 through the two projections. In the state shown in FIG. 23, the feed pawl 65 is in its free rotation position. In this state, neither the normal engagement projection 66 nor the reverse engagement projection 67 is engaged with the transmission teeth 64 of the ratchet wheel 62, which enables the load chain on the loaded side to be put in a tensed condition in advance with facility by pulling the load chain on the unloaded side, as aforementioned. FIG. 24 shows the state of the feed pawl 65 being in its reverse engagement position. In the state as shown in FIG. 24, the two projections formed as the reverse engagement projection 67 are engaged with the two transmission teeth 64 of the ratchet wheel 62, which enables the engagement between the feed pawl and the ratchet wheel to be more reliable and also enables the driving power to be dispersedly transmitted to the transmission teeth 64 through the two projections. Thus, this modification of the normal engagement projection 66 and the reverse engagement projection 67 each being formed of two projections can provide the advantageous effect of enabling the ratchet wheel 62 to be reduced in diameter to contribute to reduction of the size of the apparatus, with exact and reliable hoisting and lowering operations ensured.

What is claimed is:

1. A hoist and traction apparatus comprising:

a body having a hook;

a load sheave rotatably supported in said body;

a drive shaft for driving said load sheave;

a driven member connected with said drive shaft to be non-rotatable relative thereto;

a driving member connected with said drive shaft to be rotatable relative thereto;

a reverse rotation stop gear connected with said drive shaft to be rotatable relative thereto;

a reverse rotation stop pawl provided at said body and engageable with said reverse rotation stop gear; and an operating lever for driving said driving member, wherein said driving member has a non-circular configured part, and said operating lever comprises:

a ratchet wheel having a non-circular fitting hole engageable with said non-circular configured part to be non-rotatable relative thereto and a transmission tooth provided around its outer periphery;

a feed pawl engageable with said transmission tooth of said ratchet wheel to propel said ratchet wheel in a normal direction or in a reverse direction; and a switching means for selectively switching said feed pawl to a normal engagement position, a reverse engagement position and a free rotation position at which the feed pawl is not engaged with said ratchet wheel in either of the normal and reverse directions.

2. The hoist and traction apparatus according to claim 1, wherein said operating lever comprises a pair of side plates and a frame for enclosing the pair of side plates at their margins, said switching means comprising a spring for biasing said feed pawl toward said transmission tooth and a switching operation portion formed on said feed pawl, said feed pawl being swingably pivoted between the pair of side plates and adapted to be held at any selected position among said normal engagement position, said reverse engagement position and said free rotation position by a biasing force of said spring, said frame including therein a spring accommodating portion for accommodating said spring and a window for letting said switching operation portion out which are integrally formed in said frame.

3. The hoist and traction apparatus according to claim 1, wherein a load sheave accommodating part in which said load sheave is inserted; a chain guide passage which communicates with said load sheave accommodating part at its one end and opens to outside at the other end for guiding a load chain passing over said load sheave; and a hook mounting part are integrally formed in said body.

4. The hoist and traction apparatus according to claim 3, wherein an opening which communicates with said load sheave accommodating part to open said load sheave accommodating part to outside is formed in said body, and a chain guide for guiding said load chain into and from said load sheave is fixed in said opening so that said chain guide passage is defined at both sides of said chain guide.

5. The hoist and traction apparatus according to claim 3, wherein said body is provided, at its end portion on the opening side of said chain guide passage, with a pair of vertical grooves and a pair of horizontal grooves intersecting said vertical grooves at right angles.

6. The hoist and traction apparatus according to claim 3, wherein said hook mounting part has a penetration part penetrating widthwise of said body and an insertion hole bored in a top wall of said penetration part at a place in an upper part of said body isolated from said load sheave accommodating part, and said hook has a mounting shaft which is inserted in said insertion hole and is fixed at its inserted end portion by a fixing member inserted in said penetration part so that said hook is rotatably supported to said body.

7. The hoist and traction apparatus according to claim 3, wherein said drive shaft is integrally formed with said load sheave and also said load sheave is held to said body by means of said load chain passing over said load sheave.

8. The hoist and traction apparatus according to claim 3, wherein said body is provided, on a side wall thereof, with a first protection projecting around said reverse rotation stop gear.

9. The hoist and traction apparatus according to claim 3, wherein said body is provided, on a side wall thereof, with a second protection projecting outside said reverse rotation stop gear.

10. The hoist and traction apparatus according to claim 3, wherein said body is composed of two or more split bodies.

* * * * *

UNITED STATES PATENT AND TRADEMARK OFFICE

CERTIFICATE OF CORRECTION

PATENT NO. : 5,971,364

DATED : October 26, 1999

INVENTOR(S) : Yosio Ueno, Eikiti Kobayasi

It is certified that error appears in the above-identified patent and that said Letters Patent is hereby corrected as shown below:

Figure 4 should be deleted to appear as per attached:

Signed and Sealed this

First Day of August, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO : 5,971,364

DATED : October 26, 1999

INVENTOR(S) : Yosio Ueno, Eikiti Kobayasi

It is certified that error appears in the above-identified patent and that said Letters Patent is hereby corrected as shown below:

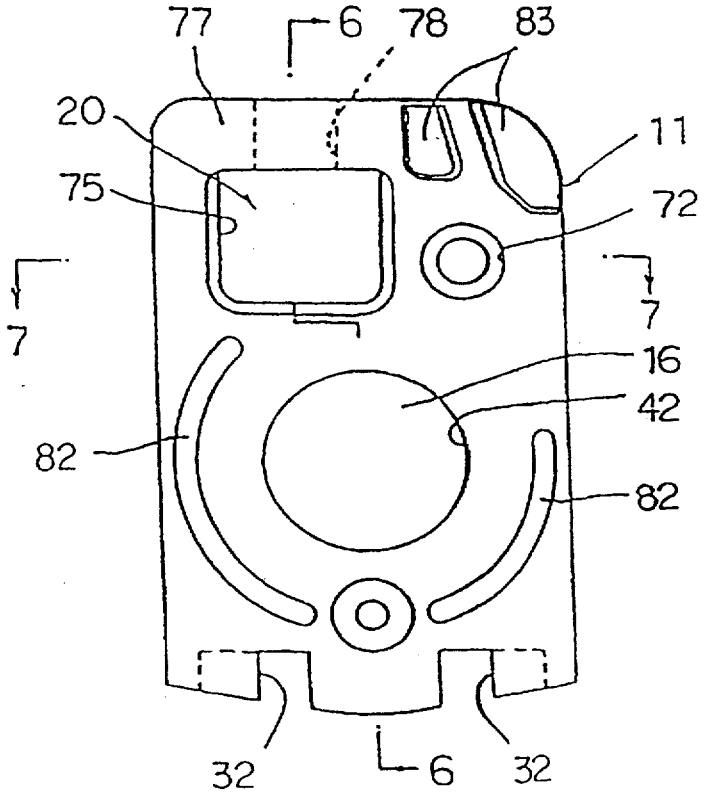

Fig. 4